US012397344B2

(12) United States Patent
Reiterer et al.

(10) Patent No.: US 12,397,344 B2
(45) Date of Patent: Aug. 26, 2025

(54) METHOD FOR CONTROLLING A CASTING PROCESS, CONTROL SYSTEM FOR A CASTING PROCESS, APPARATUS AND COMPUTER PROGRAM

(71) Applicant: Nemak, S.A.B. de C.V., Nuevo Leon (MX)

(72) Inventors: Florian Reiterer, Gallneukirchen (AT); Alexander Mokre, Linz (AT); Gerald Jax, Linz (AT); Ricardo Fernández Gutiérrez, Mauthausen (AT)

(73) Assignee: Nemak, S.A.B. de C.V., Nuevo Leon (MX)

( * ) Notice: Subject to any disclaimer, the term of this patent is extended or adjusted under 35 U.S.C. 154(b) by 0 days.

(21) Appl. No.: 18/729,722

(22) PCT Filed: Jan. 3, 2023

(86) PCT No.: PCT/IB2023/050024

§ 371 (c)(1),
(2) Date: Jul. 17, 2024

(87) PCT Pub. No.: WO2023/139438

PCT Pub. Date: Jul. 27, 2023

(65) Prior Publication Data

US 2024/0416412 A1 Dec. 19, 2024

(30) Foreign Application Priority Data

Jan. 18, 2022 (EP) ..... 22152063

(51) Int. Cl.
*B22D 17/32* (2006.01)
*B22D 46/00* (2006.01)

(52) U.S. Cl.
CPC ..... *B22D 17/32* (2013.01); *B22D 46/00* (2013.01)

(58) Field of Classification Search
CPC ..... B22D 17/32
(Continued)

(56) References Cited

U.S. PATENT DOCUMENTS 11,344,946 B2 5/2022 Yamamoto
2014/0374051 A1* 12/2014 Schickmair ..... B22D 47/00 164/458

FOREIGN PATENT DOCUMENTS

CN 102274947 A 12/2011
CN 104023875 A 9/2014
(Continued)

OTHER PUBLICATIONS

D.M. Maijer et al, "An investigation of Predictive Control for Aluminum Wheel Casting Via a Virtual Process Model," Journal of Materials Processing Technology, Feb. 19, 2009, pp. 1965-1979, vol. 209 Issue 4. (Year: 2009).*
(Continued)

*Primary Examiner* — Keith Walker
*Assistant Examiner* — Jacky Yuen
(74) *Attorney, Agent, or Firm* — The Webb Law Firm

(57) ABSTRACT

A method for controlling, in particular for temperature control, a casting process, in particular a gravity die casting process, including control of at least one input variable indicative of at least one input variable of the casting process, in particular as a function of at least one output variable indicative of at least one temperature of the casting process, in particular for a temperature of a casting mould. A temperature difference between the temperature of the casting process and a preset temperature profile is minimized. The control of the at least one input variable is based on a model predictive control. The present invention also relates to a control system for a casting process, in particular for a permanent mold casting process, a device including at
(Continued)

Figure 1:
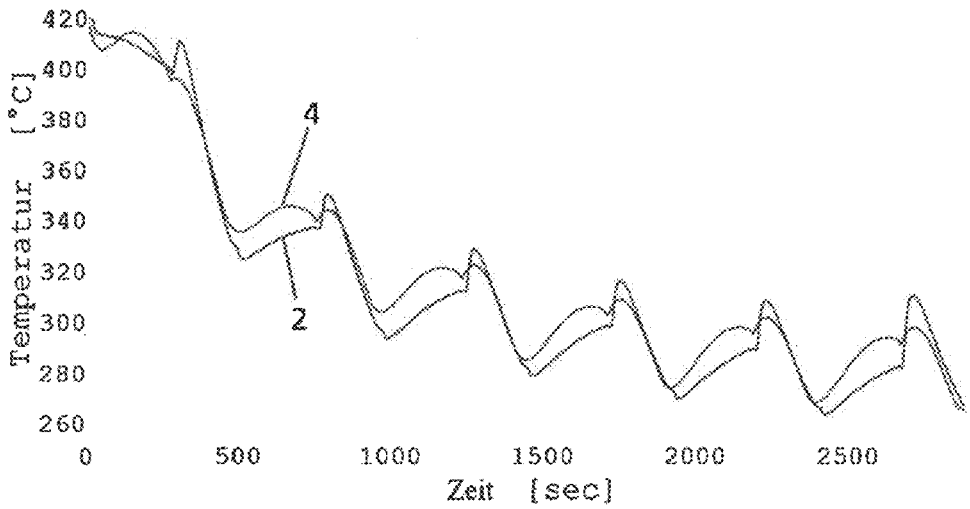

least one processor and at least one memory as well as a computer program including program instructions.

19 Claims, 2 Drawing Sheets

(58) Field of Classification Search
USPC ..... 700/146
See application file for complete search history.

(56) References Cited

FOREIGN PATENT DOCUMENTS

| | | | |
|---|---|---|---|
| CN | 106077555 | A | 11/2016 |
| CN | 110991605 | A | 4/2020 |
| CN | 112423911 | A | 2/2021 |
| CN | 113823359 | A | 12/2021 |
| DE | 102007017690 | A1 | 10/2008 |
| DE | 102019100606 | A1 | 7/2020 |
| JP | 201948322 | A | 3/2019 |
| JP | 2020157333 | A | 10/2020 |

OTHER PUBLICATIONS

D.M. Maijer, "An Investigation of Predictive Control for Aluminum Wheel Casting Via a Virtual Process Model", Journal of Materials Processing Technology, Feb. 19, 2009, pp. 1965-1979, vol. 209 Issue 4.

* cited by examiner

METHOD FOR CONTROLLING A CASTING PROCESS, CONTROL SYSTEM FOR A CASTING PROCESS, APPARATUS AND COMPUTER PROGRAM

CROSS-REFERENCE TO RELATED APPLICATIONS

This application is the United States national phase of International Application No. PCT/IB2023/050024 filed Jan. 3, 2023, and claims priority to European Patent Application No. 22152063.8 filed Jan. 18, 2022, the disclosures of which are hereby incorporated by reference in their entireties.

BACKGROUND OF THE INVENTION

Field of the Invention

The invention relates to a method for controlling, in particular for temperature controlling, a casting process, in particular a permanent mold casting process, comprising: control of the at least one input variable indicative of at least one input value of the casting process, preferably depending on at least one output variable indicative of at least one temperature of the casting process, in particular of a temperature of a casting mould, further preferably of a temperature trajectory of the casting process or of the casting mould, such that a temperature difference between the temperature of the casting process and a preset temperature profile is minimized.

The present invention also relates to a control system for a casting process, in particular for a permanent mold casting process, comprising at least one control means for controlling at least one input variable indicative of at least one input value of the casting process, in particular as a function of at least one output variable indicative of at least one temperature of the casting process, in particular for a temperature of a casting mould, further preferably for a temperature trajectory of the casting process or of the casting mould, such that a temperature difference, in particular a predicted temperature difference, of the temperature of the casting process to a preset temperature profile is minimized. The present invention also relates to a device and a computer program.

Description of Related Art

Methods for controlling the temperature of casting processes are already known from the prior art. Essentially, a distinction is made between two conventional control options, namely so-called feedforward control and simple feedback control.

In feedforward control, at least one input variable, which is indicative of at least one input value of the casting process, is preset by a process engineer before the respective casting cycles.

For example, the at least one input variable is indicative of at least one input value if it allows conclusions to be drawn about the input value. In particular, the at least one input variable may be measured values and/or data indicative of the at least one input value. For example, the input variable may be the input value itself or measured values and/or data that represent the input value or from which the input value can be derived. For example, the at least one input value may be a temperature of a coolant in Kelvin, in which case the at least one input variable may also be the temperature of the coolant in Kelvin or other measured values and/or data that represent the temperature of the coolant or from which the temperature of the coolant can be derived. Preferably, the above also applies with regard to the at least one output variable indicative of at least one output value. In this respect, the at least one input value or the at least one output value refers in particular to the physical condition, for example the temperature of the coolant in Kelvin, whereas the at least one input variable or the at least one output variable can also refer to measured values and/or data which allow conclusions to be drawn about the at least one input value or the at least one output value and/or which represent the at least one input value or the at least one output value.

The usually set input variables are indicative, for example, of the flow rates of a coolant or the cooling times during a casting cycle. In practice, however, it has been shown that this type of forward control can lead to considerable temperature fluctuations between individual casting cycles, which in particular can lead to inaccuracies in the production of individual castings.

In simple feedback control, for example, the flow rate of a coolant is controlled as a function of at least one measuring device, in particular a thermocouple, located in the mold. If, for example, the temperature measured by the at least one thermocouple exceeds a preset temperature limit, a coolant flow is activated. The coolant flow is activated until the temperature measured by the at least one thermocouple falls below a further preset temperature limit. A control strategy described in this way can also be referred to as bang-bang control and is possible in many commercial permanent mold casting systems. Although information from the respective casting process, in particular the temperature measured by a thermocouple, is used here, the reaction time of such a control system is slow, as it can only react to temperature fluctuations that have already taken place. It has been shown that significant temperature peaks can occur with such a control, in particular shortly after the mold is filled with the mold filling or the melt.

SUMMARY OF THE INVENTION

In this respect, the present invention is based on the task of providing a method for controlling, in particular for temperature controlling, a casting process, in particular a permanent mold casting process, which enables improved control of the measured temperatures within a desired range. A control system for a casting process, a device and a computer program comprising program instructions which enable improved temperature control of a casting process are also to be provided.

According to a first aspect of the invention, the aforementioned task is solved in the aforementioned method in that the control of the at least one input variable is based on model predictive control. This enables improved temperature control of the casting process, since future temperatures of the casting process, in particular future temperature trajectories, can be calculated by means of the model-predictive control and the at least one input variable, which is indicative, for example, of a flow rate of a coolant, can be controlled as a function of the calculated temperature trajectories. In this way, the at least one input variable can be proactively adjusted, whereby temperature fluctuations within a casting cycle and also between casting cycles can be reduced.

In the present case, model predictive control can be based in particular on a so-called MPC model. In model predictive control, the aim is to achieve a preset temperature profile, which is a target temperature profile. The preset temperature profile can, for example, only be a target constant temperature. The aim of the control is to bring the measured and/or predicted temperature of the casting process, in particular the temperature of the mold, as close as possible to the target temperature profile during or between casting cycles. For this purpose, not only can the current state of the process be monitored, for example at discrete time intervals, for example by recording the at least one output variable, but the state of the process can also be estimated and controlled for a specific future time interval. The model predictive control is therefore based on an optimization problem, namely to optimize the output variable with regard to the preset temperature profile by controlling the at least one input variable.

For example, the optimization problem can include a cost function, whereby the cost function is to be minimized. The mold filling as a measured disturbance variable and the at least one input variable can be taken into account. In particular, at least two input variables are taken into account, which are preferably indicative of the flow rate of a coolant and the heating rate of a heating source.

An exemplary cost function that can be optimized using model predictive control can be based on the following formula, for example:

$$V_K \triangleq \sum_{i=1}^{n_{PH}} \left\|\hat{y}_{k+i|k} - r_{k+i}\right\|_{Q_i}^2 + \sum_{i=0}^{n_{CH}-1} \left\|\Delta\hat{u}_{k+i|k}\right\|_{R_i}^2 + \sum_{i=0}^{n_{CH}-1} \left\|\hat{u}_{k+i|k}\right\|_{S_i}^2.$$

The first summation term penalizes $$\sum_{i=1}^{n_{PH}} \left\|\hat{y}_{k+i|k} - r_{k+i}\right\|_{Q_i}^2$$

for example, the temperature difference between the output variable indicative of a predicted temperature or indicative of a predicted temperature trajectory and a preset temperature profile. $|\hat{y}_{k+i|k|}|$ can, for example, correspond to the predicted temperature or the predicted temperature trajectory. For example, $|\hat{y}_{k+i|k|}|$ is calculated using the transfer function G(s) described below and the input variables $\hat{u}_{k+i|k}$. Furthermore, it is preferred that the term $r_{k+i}$ corresponds to the preset temperature profile.

The second summation term $$\sum_{i=0}^{n_{CH}-1} \left\|\Delta\hat{u}_{k+i|k}\right\|_{R_i}^2$$

penalizes changes in the input variables, for example. In particular, this can affect changes in the flow rate of a coolant or the heating rate of a heating source. $\Delta\hat{u}_{k+i|k}$ can, for example, indicate the change in at least one input variable between the time k+1 and the previous time.

The third summation term $$\sum_{i=0}^{n_{CH}-1} \left\|\hat{u}_{k+i|k}\right\|_{S_i}^2$$

penalizes the input variables directly, for example. In particular, this ensures that the absolute amount of coolant flow or the absolute heating rate of a heat source is minimized.

The degrees of freedom of the model-predictive control or the optimization problem are determined by the variables $n_{PH}$, $n_{CH}$ and the weighting matrices Q, R and S.

For example, the variable $n_{PH}$ specifies the number of time intervals for which the calculation is to be carried out. A time interval can lie in a range between 0.5 s and 10 s, for example.

The variable $n_{CH}$ specifies, for example, the number of time intervals for which at least one input variable can be changed.

Preferably, the variables $n_{PH}$ and $n_{CH}$ can be adapted with regard to the underlying optimization problem. For example, it is preferred that the variable $n_{PH}$ specifies at least the duration of a casting cycle, which can last between 1 min and 10 min, for example.

The weighting matrices Q, R and S indicate in particular how heavily the individual sum terms are weighted in the overall evaluation. For example, the weighting matrices Q, R and S can be unit matrices with the constants q, r and s on the diagonal. Such a design has proven to be advantageous when using model predictive control to reduce complexity while achieving satisfactory results.

Preferably, an output variable is recorded. The detected output variable indicative of at least one temperature of the casting process, in particular for a temperature of a casting mold, may, for example, be the measured value of a thermocouple arranged in the casting mold. For example, the thermocouple can be arranged at least partially inside the casting mold and thus reliably measure the temperature inside the casting mold. With regard to increased measurement accuracy, it is preferred that several thermocouples are arranged at least partially within the casting mold.

Preferably, at least one input variable is controlled indicatively for at least one input value of the casting process based on the model predictive control. In particular, the at least one input variable is indicative of a flow rate of a coolant, whereby the coolant flows, for example, through channels arranged in the mold and thereby cools the mold. This enables the temperature of the mold to be set reliably.

Furthermore, it has proven to be particularly advantageous in practice if a further input variable is controlled by means of the model-predictive control, whereby the further input variable is preferably indicative of at least one heating rate of a heating element or a heating source arranged in the casting mold. This makes it possible to quickly adapt the temperature of the mold to a preset temperature profile as part of the model predictive control.

A preferred embodiment of the present invention is characterized in that the model predictive control comprises a model, in particular a dynamic model, in that the model is identified and/or adapted based on a data set, wherein the data set comprises data indicative of the at least one input variable and the at least one output variable, and in that a correlation between the at least one input variable and the at least one output variable is determined by means of the model based on the data set. Preferably, the data set comprises several input variables, in particular at least two different input variables. Optionally, correlations and/or interactions between the input variables can also be determined using the dynamic model. By calculating the correlation and/or the interactions of the input variables and/or the correlation to the output variables, an effect of a change in one of the variables on another one of the variables can be calculated in a reliable manner.

For example, the aforementioned model can be based on a grey box model. Alternatively, the aforementioned model can also be purely data-based or based on principles known from the prior art, which are subsequently parameterized by data.

For example, a grey box model can be represented by the following formula:

$$Y_{out}(s) = \sum_{k=1}^{n} G_i(s)U_{in,i}(s).$$

$Y_{out}$ is preferably the output variable that is indicative of at least one temperature of the casting process. The different input variables are preferably referred to as $U_{in,i}$, whereby a total of n different input variables may be present. For example, the various input variables can be in the Laplace range. The function Gi(s) is preferably a transfer function, which can be represented in particular by the following formula for the individual input variables:

$$G_i(s) = \frac{K_i}{(1 + T_i)^2}.$$

A gain factor of the respective input variable is preferably specified as $K_i$, whereby $T_i$ in particular can be a time constant.

It has been shown that the illustrated grey box model can be used to specify an advantageous model for calculating the correlation between the at least one input variable and the at least one output variable.

A further preferred embodiment of the invention is characterized in that the data set comprises historical data, in particular data from casting tests already performed and/or data from a series production, wherein the data set is preferably extended by data recorded during the performance of the casting process, and/or in that the model is parameterized by means of estimated values, wherein the model is preferably validated and/or extended by recorded data during the performance of the casting process. This makes it possible to base the model on a data set which allows the correlation between the at least one input variable, the at least one output variable and, for example, disturbance variables to be taken into account.

In particular, the historical data can be data from casting tests that have already been carried out. In particular, data from the same casting process and the same casting device can be used, whereby the model predictive control can be further improved. It is preferable that the underlying data set is extended by the past measured values after the casting cycles have been carried out. This allows a representative data set to be made available.

The estimated values for individual parameters of the model can, for example, be based on the empirical values of a process engineer. Alternatively, the estimated values can be determined using a conventional simulation environment, for example. Preferably, the estimated values are validated or adjusted after casting cycles have been carried out, so that it can be ensured that the adjusted model describes the measured data with sufficient accuracy.

In a preferred embodiment of the present invention, the model predictive control takes into account the at least one input variable and/or the one output variable as well as their correlation to each other based on the model. In this way, various possible temperature trajectories can be calculated in a reliable manner by means of the model-predictive control and the at least one input variable can be controlled in such a way that a temperature difference, in particular a predicted temperature difference, of the temperature of the casting process to a preset temperature profile is minimized. Furthermore, it is preferred that, in the case of several input variables, the model-predictive control also takes into account the correlation between the several input variables based on the aforementioned model.

A further preferred embodiment of the invention is characterized in that the model predictive control further takes into account a filling of the mould as a measured disturbance and the correlation of the disturbance to the at least one input variable and/or the at least one output variable based on the dynamic model. This enables reliable model-predictive control of the at least one input variable and/or the at least one input variable since the behavior of the casting mold filling or deviations of the casting mold filling can also be included in the model-predictive control as a measured disturbance. The mold filling as a disturbance variable can be, in particular, the time of the mold filling, the composition of the mold filling, the quantity of the mold filling and/or the temperature of the mold filling.

In a further advantageous embodiment of the present invention, the at least one input variable is a flow rate of a coolant, a temperature of a coolant, a duration of a casting cycle, a quantity of a mold filling, a composition of a mold filling, a temperature of a mold filling, a time of a mold filling, a temperature of a heating source and/or a heating rate of a heating source or a heating device. In this way, an input variable can be controlled indicatively for one of the aforementioned input variables in such a way that a temperature difference between the temperature of the casting process and a preset temperature profile is minimized. It is preferred that an input variable is indicative of an input variable in each case. Preferably, several of the aforementioned input variables can also occur more than once, for example if several cooling circuits for coolant are present during the casting process.

It is particularly preferred that the at least one input variable is indicative of the flow rate of a coolant. This allows the flow rate of a coolant to be controlled based on the model predictive control in such a way that the aforementioned temperature difference is minimized.

Preferably, at least two input variables are controlled indicatively for two input variables of the casting process. In practice, it has proven to be preferable in terms of control accuracy if two input variables are used, whereby one input variable is indicative of the flow rate of the coolant and one input variable is indicative of the heating rate of a heating source. This makes it possible to adjust both the flow rate of the coolant and the heating rate of the heating source based on the model predictive control.

In a further preferred embodiment of the present invention, the model predictive control comprises a Kalman filter and the state of the casting process, in particular the system state and the state of the at least one output variable, is calculated by means of the Kalman filter, in particular at defined time intervals. This allows the state of the casting process to be calculated reliably. In particular, the state of the casting process is calculated based on the detection of the at least one input variable and the at least one output variable. Using the current state of the casting process, the various future temperature trajectories can be calculated as part of the model predictive control, on the basis of which the at least one input variable can be controlled.

A preferred embodiment of the invention is characterized in that the model predictive control predicts various trajectories of the at least one output variable by means of the state calculated by the Kalman filter model, and in that the at least one input variable is controlled by means of the model predictive control in such a way that a predicted trajectory of the output variable is set which is indicative of a minimum temperature difference between the temperature of the casting process and the preset temperature profile. This enables advantageous temperature control of the casting process, so that the casting process can be optimized and the amount of casting defects can be reliably reduced. Preferably, the aforementioned calculation is carried out after one of the defined time intervals has elapsed. Accordingly, the at least one input variable is changed at each defined point in time depending on the previously described optimization problem based on the state predicted by means of the Kalman filter model in order to adapt the actual temperature of the casting mould to the preset temperature profile.

A further preferred embodiment of the present invention is further characterized in that the model predictive control takes into account constraints of the casting process, in particular constraints of the at least one input variable and/or the at least one output variable. In this way, technical limitations of the casting process can be advantageously taken into account in the model predictive control. For example, such limitations are a maximum flow rate of the coolant, a maximum heating rate of the heating source and/or a maximum rate of change of the coolant flow.

In a further preferred embodiment of the present invention, the at least one output variable is detected indicatively of at least one temperature of the casting process by means of at least one thermocouple, in particular by means of at least one thermocouple arranged at least partially within a casting mold. This enables reliable detection of the at least one output variable.

According to a second aspect of the present invention, the aforementioned task is solved in a control system for a casting process in that the control means regulates the at least one input variable based on a model predictive control. The embodiments and advantages described in connection with the aforementioned method apply equally to the control system according to the invention.

A control system can, for example, be a device for evaluating data, controlling further devices and/or outputting signals. The control system can, for example, be a component of a casting device, a casting device and/or a casting system.

The control system can comprise hardware and/or software components. For example, the control system may comprise at least one memory with program instructions of a computer program and at least one processor designed to execute program instructions from the at least one memory. Accordingly, in particular, control devices are also to be understood as disclosed which comprise at least one processor and at least one memory with program instructions, wherein the at least one memory and the program instructions are set up to control the at least one input variable together with the at least one processor. The at least one input variable is controlled, for example, via a control connection.

Preferably, the control system is configured to perform a method described above.

According to a third aspect of the present invention, the aforementioned task is solved by a device comprising at least one processor and at least one memory containing program code, wherein the memory and the program code are configured to use the at least one processor to cause a device to execute and/or control at least the aforementioned method. Either all steps of the method can be controlled, or all steps of the method can be executed, or one or more steps can be controlled and one or more steps can be executed.

In an exemplary embodiment, the system according to the third exemplary aspect of the present invention comprises at least a control system according to the second aspect of the present invention and a casting system suitable for carrying out a method according to the first aspect of the present invention.

The aforementioned problem is also solved according to a fourth aspect of the present invention by a computer program, in that the computer program comprises program instructions which cause a processor to execute and/or control the aforementioned method when the computer program is running on the processor. In this specification, a processor is to be understood to mean, inter alia, control units, microprocessors, microcontroller units such as microcontrollers, digital signal processors (DSP), application-specific integrated circuits (ASICs) or field programmable gate arrays (FPGAs). Either all steps of the process can be controlled, or all steps of the process can be executed, or one or more steps can be controlled and one or more steps can be executed. The computer program can, for example, be distributable via a network such as the Internet, a telephone or mobile phone network and/or a local network. The computer program may be at least partially software and/or firmware of a processor. It can also be implemented at least partially as hardware. The computer program may, for example, be stored on a computer-readable storage medium, e.g. a magnetic, electrical, electro-magnetic, optical and/or other type of storage medium. The storage medium may, for example, be part of the processor, for example a (non-volatile or volatile) program memory of the processor or a part thereof. The storage medium is, for example, tangible and/or non-transitory.

The above-described embodiments and exemplary embodiments of all aspects of the present invention, which in principle initially stand alone, are also to be understood as disclosed in all combinations with one another.

Further advantageous exemplary embodiments of the aspects of the invention are to be taken from the following detailed description of some exemplary embodiments of the present invention, in particular in connection with the figures. However, the figures accompanying the application are intended only for the purpose of clarification and not for determining the scope of protection of the invention. The accompanying drawings merely reflect the general concept of the present invention by way of example. In particular, features contained in the figures are in no way to be understood as a necessary part of the present invention.

BRIEF DESCRIPTION OF THE INVENTION

Figure 2:
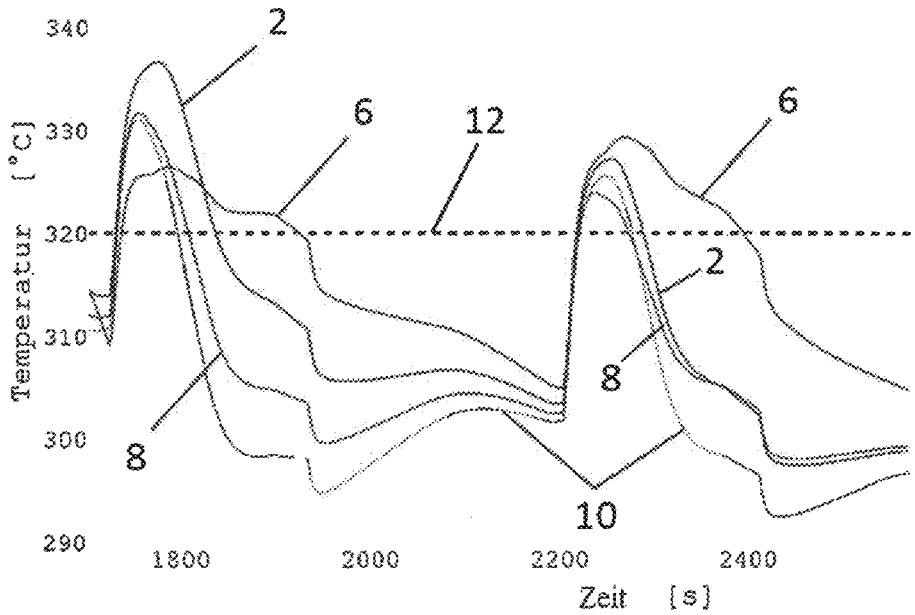
Figure 3:
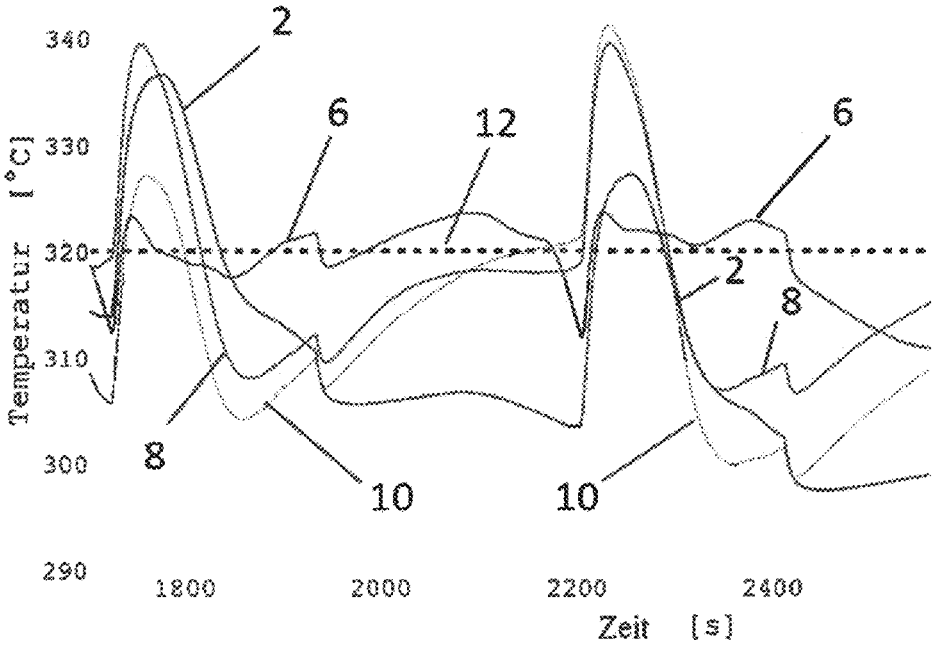

In the following, the invention is explained with reference to the drawing by means of examples of embodiments. The drawing shows FIG. 1 an exemplary comparison of measured temperature data and temperature data calculated by means of a model;

FIG. 2 an exemplary representation of different temperature curves based on different controls for temperature control of a casting process; and FIG. 3 a further exemplary representation of different temperature curves based on different controls for controlling the temperature of a casting process.

DESCRIPTION OF THE INVENTION

FIG. 1 shows an exemplary comparison of a temperature curve 2 of a realistic simulation and a temperature curve 4 calculated using a model. The temperature curve 4 calculated using the model, in particular using the dynamic model, deviates only slightly from the temperature curve 2 of the realistic simulation, so that the basic system dynamics of the casting process can be reliably reproduced by the dynamic model.

To create the dynamic model, data from a vehicle subframe component made of an aluminum alloy produced using the casting process was used.

A realistic simulation was first used to create a data set by means of which the system dynamics of the available data were identified. Such a realistic simulation is preferably a simulation for casting processes. In this case, a simulation from Magmasoft® was used.

The realistic simulation was used to change various input variables indicative for different input values so that a comprehensive data set is available. To determine an output variable indicative of a temperature in the mold, a fixed position of a thermocouple in the mold was selected. In this case, the following different input values and the input variables indicative of these input values were taken into account in the simulation:

- the flow rate of the coolant in two cooling circuits close to the specific position of the thermocouple; and
- the heating rate of a heating source or heating element close to the specific position of the thermocouple.

The filling of the mold with a melt or the mold filling was also taken into account as a measured disturbance.

The mold filling was modeled as a Dirac pulse, whereby the respective Dirac pulse is triggered as soon as the mold filling flows into the mold in the simulation. In the context of model predictive control, the mold filling can also be referred to as a measured disturbance.

The following process model was adapted to the data determined in the simulation:

$$Y_{out}(s) = \sum_{k=1}^{n} G_i(s) U_{in,i}(s);$$

$Y_{out}$ is the output variable that is indicative of at least one temperature of the casting process. The input variables indicative of the aforementioned input variables are referred to as $U_{in,\ i}$. The function $G_i(s)$ is a transfer function which can be represented by the following formula for the individual input variables:

$$G_i(s) = \frac{K_i}{(1 + T_i)^2}.$$

$K_i$ is a gain factor of the respective input variable, where $T_i$ is a time constant.

As shown in FIG. 1, the predicted temperature curve of the identified dynamic model deviates only slightly from the temperature curve of the realistic simulation, so that the dynamic model reliably predicts the temperature curves that occur during the casting process.

FIG. 2 shows an example of various temperature curves based on different temperature control systems for a casting process. The temperature profile of a realistic simulation 2, the temperature profile of the model predictive control 6, the temperature profile of a PID control 8 and the temperature profile of a bang-bang control 10 were compared with each other. A constant temperature trajectory of 320° C. was selected as the preset temperature profile 12.

The model predictive control 6 was based on a prediction horizon of $n_{PH}$=1000 for a time interval of ΔT=1 s. Accordingly, 1000 time intervals of 1 s each are included in the calculation. The control horizon $n_{CH}$ was also set at 100 for a time interval of ΔT=1 s, so that the input variables can be changed for 100 time intervals.

The weighting matrices Q, R and S were selected as unit matrices with the constants q, r and s on the diagonal, where q=1,000,000; r=1; and s=0.

As an input variable indicative of an input variable, an input variable indicative of a flow rate of a coolant was controlled in the controls shown in FIG. 2. It can be seen that the model-predictive control 6 enables a temperature profile that is on average closer to the preset temperature profile 12 than the other control types 8 and 10. However, since the temperature can essentially only be moved in one direction by the flow rate of the coolant, namely a temperature reduction can be caused, the model shown in FIG. 2 has technical limitations that stand in the way of further improved control.

FIG. 3 shows another example of different temperature curves based on different controls for controlling the temperature of a casting process. In contrast to the controls shown in FIG. 2, the controls shown in FIG. 3 are based on two input variables, namely an input variable indicative of the flow rate of a coolant and a further input variable indicative of the heating rate of a heating source. In this respect, the two aforementioned input variables can be controlled by the respective controllers in such a way that the respective temperature curves have the smallest possible difference to the preset temperature profile 12. As can be seen from FIG. 3 and also from a comparison of FIGS. 2 and 3, a temperature profile that is very close to the preset temperature profile can be achieved, particularly with model-predictive control 6. With the other control types 8 and 10, only a slight improvement could be achieved by controlling an additional input variable.

The exemplary embodiments of the present invention described in this specification are also to be understood as disclosed in all combinations with each other. In particular, the description of a feature encompassed by an embodiment—unless explicitly stated to the contrary—should not be understood herein to mean that the feature is indispensable or essential for the function of the exemplary embodiment.

Terms used in the claims such as "comprising", "comprising", "comprising", "containing" and the like do not exclude further elements or steps. The phrase "at least partially" includes both the case of "partially" and the case of "completely". The wording "and/or" is to be understood as meaning that both the alternative and the combination are to be disclosed, i.e. "A and/or B" means "(A) or (B) or (A and B)". A plurality of entities, persons or the like in the context of this specification means a plurality of entities, persons or the like. The use of the indefinite article does not exclude a plurality. A single device or means may perform the functions of a plurality of units or devices specified in the claims. Reference signs given in the claims are not to be regarded as limitations of the means and steps employed.

The invention claimed is:

1. A method for temperature controlling a casting process comprising:

control of at least one input variable indicative of at least one input value of the casting process depending on at least one output variable indicative of at least one temperature of the casting process in such a way that a temperature difference between the temperature of the casting process and a preset temperature profile is minimized, wherein the control of the at least one input variable is based on a model predictive control, the model predictive control comprises a model, the model is identified and/or adapted on the basis of a data set, the data set having data indicative of the at least one input variable and the at least one output variable, and a correlation between the at least one input variable and the at least one output variable is determined by means of the model based on the data set, the at least one input variable is a flow rate of a coolant, a temperature of a coolant, a duration of a casting cycle, a quantity of a mold filling, a composition of a mold filling, a temperature of a mold filling, a time of a mold filling, a temperature of a heating source and/or a heating rate of a heating source, the data set comprises historical data, the data set being extended by data recorded during the carrying out of the casting process, the model predictive control comprises a Kalman filter, the state of the casting process, is calculated by means of the Kalman filter model the model-predictive control further takes into account a filling of the mold as a measured disturbance variable and the correlation of the disturbance variable to the at least one input variable and/or the at least one output variable based on the dynamic model, the model predictive control predicts different trajectories of the at least one output variable by means of the state calculated by the Kalman filter model, and the model predictive control is used to control the at least one input variable in such a way that a predicted trajectory of the output variable is set which is indicative of a minimum temperature difference between the temperature of the casting process and the preset temperature profile.

2. The method according to claim 1, wherein the model is parameterized by means of estimated values.

3. The method according to claim 1, wherein the model-predictive control takes into account the at least one input variable and the one output variable as well as their correlation to each other based on the model.

4. The method according to claim 1, wherein the model predictive control takes into account limitations of the casting process.

5. The method according to claim 1, wherein the at least one output variable is indicative of at least one temperature of the casting process detected by means of a thermocouple.

6. The method according to claim 5, wherein the at least one temperature is detected by a thermocouple arranged at least partially inside a casting mold.

7. The method according to claim 1, wherein the casting process is a permanent mold casting process.

8. The method according to claim 1, wherein the at least one temperature is a temperature of a casting mould.

9. The method according to claim 1, wherein the model comprises a dynamic model.

10. The method according to claim 1, wherein the historical data comprises data from casting tests already carried out and/or data from series production.

11. The method according to claim 1, wherein the state of the casting process includes the system state and the state of the at least one output variable.

12. The method according to claim 1, wherein the state of the casting process is calculated at defined time intervals.

13. The method according to claim 1, wherein the model is validated and/or extended by recorded data during the carrying out of the casting process.

14. The method according to claim 1, wherein the model takes into account limitations of the at least one input variable and/or the at least one output variable.

15. A control system for a casting process comprising:

at least one control means for controlling at least one input variable indicative of at least one input value of the casting process depending on at least one output variable indicative of at least one temperature of the casting process in such a way that a temperature difference between the temperature of the casting process and a preset temperature profile is minimized, wherein the control means regulates the at least one input variable based on a model predictive control, and the control system is designed to carry out the method according to claim 1.

16. The control system of claim 15, wherein the casting process is a permanent mold casting process.

17. The control system of claim 15, wherein the at least one temperature is a temperature of a casting mould.

18. A device comprising at least one processor and at least one memory containing program code, wherein the memory and the program code are configured to cause a device with the at least one processor to execute at least the method according to claim 1.

19. A non-transitory computer-readable medium storing a computer program comprising program instructions that, when executed by a processor, cause the processor to perform the method according to claim 1.

* * * * *